United States Patent [19]

Goodman

[11] 4,179,127

[45] Dec. 18, 1979

[54] THREE DIMENSIONAL CHESS GAME APPARATUS

[76] Inventor: Vernon T. Goodman, 4820 Eastern La., Apt. 103, Suiteland, Md. 20023

[21] Appl. No.: 915,005

[22] Filed: Jun. 13, 1978

[51] Int. Cl.[2] ..... A63F 3/01

[52] U.S. Cl. ..... 273/241; 273/260; 273/284

[58] Field of Search ..... 273/241, 260, 261, 118 R, 273/239, 284, 287

[56] References Cited

U.S. PATENT DOCUMENTS

| | | | |
|---|---|---|---|
| D. 210,542 | 3/1968 | Stookey | 273/241 |
| D. 215,103 | 9/1969 | Stevens | 273/241 |
| 1,732,518 | 10/1927 | Jurs | 273/DIG. 31 |
| 2,342,899 | 2/1944 | Sands, Jr. | 273/260 |
| 3,999,760 | 12/1976 | Wilson | 273/260 |

FOREIGN PATENT DOCUMENTS

| | | | |
|---|---|---|---|
| 218607 | 9/1908 | Fed. Rep. of Germany | 273/241 |

*Primary Examiner*—Richard C. Pinkham
*Assistant Examiner*—R. Carl Moy
*Attorney, Agent, or Firm*—Jacob H. Steinberg

[57] ABSTRACT

A game apparatus for checkers and chess which is three dimensional to provide a simulated perspective of a combat zone by raising or lowering each successive row of squares, a uniform distance from front and back to the center of the apparatus.

3 Claims, 4 Drawing Figures

THREE DIMENSIONAL CHESS GAME APPARATUS

A principal object of this invention is to provide a more interesting and more challenging game of chess by providing a realistically three dimensional game board apparatus.

It is a further object to provide a three dimensional chess board apparatus that can be played from back to front or from side to side.

It is a further object to provide an apparatus that can be played from a bottom level to a high level at the center of the game apparatus or, by inverting the apparatus, the game can be played from a high level to a low level at the center.

In the game of chess, the chess pieces represent two sets of chess men, white and black, which are opposed in battle alignment. This battle alignment is more realistic if played on different levels, representing embankments. To accomplish this purpose, the chess game apparatus is arranged with its parallel rows of alternate black and white squares so that each row from the two center highest rows is lowered from the next preceeding row by a uniform distance or when the game apparatus is inverted each row from the center lowest rows are raised a uniform distance.

The chess game is much more realistic because the different levels of approach is more like the attack and conquest of the opposing forces in a real life situation where the action takes place on hill and dale, a three dimensional landscape. The lowest levels of the game apparatus could simulate a watery moat or a valley while the upper rows can simulate mountains from which the attack is made.

The number of squares are increased from the standard 64 to 80 by increasing the number of squares in a row to ten squares. This enables the use of the game apparatus for playing from side to side in addition to from front to back.

It is a further object to simulate real life combat into the chess game by using the natural colors for the squares as green and brown and to as closely as possible make each of the chess pieces simulate their actual form.

For a fuller understanding of the nature and objects of this invention reference should be had to the following detailed description taken in connection with the accompanying drawing.

BRIEF DESCRIPTION OF THE DRAWING FIGURES

DETAILED DESCRIPTION

Figure 1:
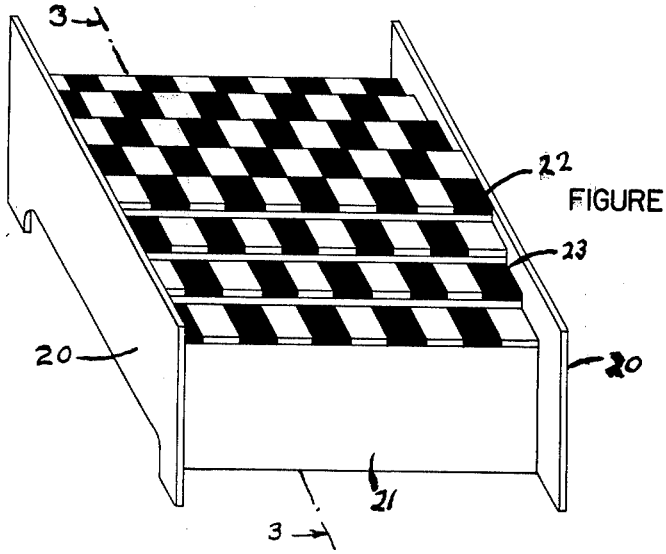
FIG. 1 is a perspective view illustrating the chess game apparatus from low rows to high rows.
Figure 2:
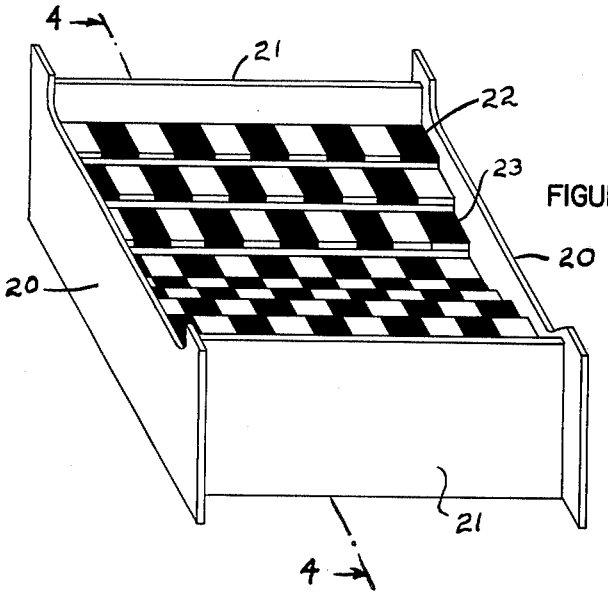
FIG. 2 is a perspective view of the chess game apparatus, as inverted, from high rows to low rows.
Figure 3:
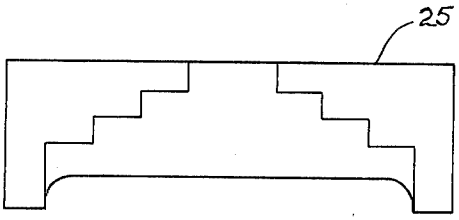
FIG. 3 is a side elevational cross-sectional view of FIG. 1 taken along line 3—3.
Figure 4:
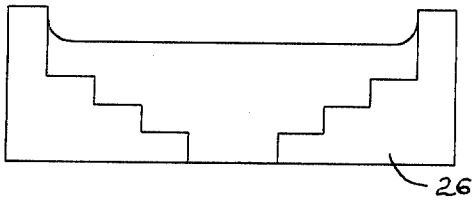
FIG. 4 is a side elevation cross-sectional view of FIG. 2 taken along line 4—4.

Referring to the drawings wherein like numerals designate like parts, and referring to FIGS. 1 and 2, there is shown a chess apparatus comprising a three dimensional arrangement of black and white squares wherein the play area is supported by two 24"×7" boards 20 shaped as illustrated with cross boards 21, and rows of squares 22 constructed as to represent a flight of steps going from down to up, as in FIG. 1 and FIG. 3, or going from up to down as shown in FIG. 2 and FIG. 4. FIGS. 3 and 4 show side elevational views of members 25 and 26.

Though the number of squares 23 can be 8 in a row and 8 rows, a total of 64 squares, which is conventional, it is preferred to increase each row to 10 squares, yielding a total of 80 squares. The increase in squares is essential if the chess apparatus is to be used from side to side as well as front to back. This game apparatus can be set up for playing in four different ways. Two ways have been described. The other two ways involve inverting the game apparatus as in FIG. 2 which also can be played from side to side as well as from front to back.

During use of the apparatus, the games of checkers or chess are played in the traditional manner except the plays or moves are performed in a vertical plane as well as a horizontal plane. This tends to make the game more interesting and challenging. The game of chess was originally a copy of actual battle scenes of roughened terrain, including valleys, hills, and moats. This game apparatus is therefore constructed to simulate this three dimensional field. As a further simulation other contrasting colors may be used instead of black and white. For instance, brown for ground and green for herbage. The frame may be also colored in a naturally occurring shade. The number of players could be increased to four because all four sides can be in play. Each player moves when his portion of the play area is involved. A more realistic setting can be provided by additionally modifying the shape of each chess piece to make them simulate actual warriors, people, and castles.

In order to provide a storing place for the checkers and chess pieces, a drawer on sliding tracks can be provided at the front and back members so that the checkers can be stored separately from the chess pieces.

The terms and expressions which have been employed herein are used as terms of description and not of limitation, and there is no intention, in the use of such terms and expressions of excluding any equivalents of the features shown and described or portions thereof but it is recognized that various modifications are possible within the scope of the invention claimed.

What is claimed is:

1. A gameboard for chess or checkers having an obverse side comprising a conventional checkerboard grid of square spaces, alternately colored in a checkered pattern, each row of said grid consisting of 8 said square spaces, the rows being in stepped configuration with the 2 outermost rows being at the lowest level, and each successively more inward row being raised an additional level from the preceding row, so that the centermost 2 rows are highest, said gameboard further having a reverse side comprising a grid identical to that on the obverse side in size and coloration but wherein successively more inward rows are lowered one additional level from that of the preceding row so that the centermost 2 rows are lowest, the elevations on the obverse side thereby corresponding to depressions on the reverse side.

2. The game apparatus of claim 1 wherein the number of alternate squares are 80 including 10 in each row and 8 rows.

3. The game apparatus of claim 1 wherein the alternate colors of the squares are green and brown for closer simulation of natural terrain.

* * * * *